US007198514B1

(12) United States Patent
Grimes

(10) Patent No.: US 7,198,514 B1
(45) Date of Patent: Apr. 3, 2007

(54) JUNCTION BOX APPARATUS

(76) Inventor: Steve M. Grimes, 3229 S. Mount Carmel, Wichita, KS (US) 67217

( * ) Notice: Subject to any disclaimer, the term of this patent is extended or adjusted under 35 U.S.C. 154(b) by 0 days.

(21) Appl. No.: 11/298,492

(22) Filed: Dec. 12, 2005

(51) Int. Cl.
*H01R 13/60* (2006.01)

(52) U.S. Cl. ..... 439/538; 174/57

(58) Field of Classification Search ..... 439/535–538; 174/54–59
See application file for complete search history.

(56) References Cited

U.S. PATENT DOCUMENTS

| | | | | | |
|---|---|---|---|---|---|
| 1,567,863 | A | * | 12/1925 | Sargent, et al. | 174/57 |
| 3,617,611 | A | * | 11/1971 | Kuether | 174/51 |
| 3,663,919 | A | * | 5/1972 | Jaconette | 439/97 |
| 3,728,468 | A | * | 4/1973 | Grauer | 174/51 |
| 3,770,872 | A | * | 11/1973 | Brown | 174/53 |
| 4,012,580 | A | * | 3/1977 | Arnold | 174/53 |
| 4,019,647 | A | * | 4/1977 | Arnold | 220/3.3 |
| 4,223,178 | A | * | 9/1980 | Lass | 174/659 |
| 4,599,485 | A | * | 7/1986 | Smolik | 174/57 |
| 4,854,885 | A | * | 8/1989 | Bowden et al. | 439/107 |
| 4,948,317 | A | * | 8/1990 | Marinaro | 411/535 |
| D331,040 | S | | 11/1992 | Mielko | |
| 5,434,359 | A | | 7/1995 | Schnell | |
| 5,594,207 | A | | 1/1997 | Fabian et al. | |
| 5,823,821 | A | * | 10/1998 | Tohanczyn, Jr. | 439/538 |
| 6,170,685 | B1 | | 1/2001 | Currier | |
| 6,369,323 | B1 | * | 4/2002 | Wright | 174/51 |
| 6,423,899 | B1 | | 7/2002 | Reiker | |
| 6,740,810 | B1 | | 5/2004 | Regueiro | |

* cited by examiner

*Primary Examiner*—Briggittte Hammond
*Assistant Examiner*—Larisa Tsukerman

(57) ABSTRACT

A junction box apparatus includes a housing that has a front side which is open and has an upper edge, a lower edge. The bottom wall has a plurality of first aligned slots therein positioned adjacent to the lower edge. The top wall has a plurality of second aligned slots therein positioned adjacent to the upper edge. Each of a pair of mounting members is provided and each has an aperture extending therethrough. Fasteners may be extended through mounting tabs on an electrical outlet and into one of the mounting members. Each coupler, of a pair of couplers, is attached to one of the mounting members. The couplers are each is removably extendable into one of the slots of the first and second aligned slots so that the apertures are orientated substantially perpendicular to a plane of the front side.

7 Claims, 5 Drawing Sheets

JUNCTION BOX APPARATUS

BACKGROUND OF THE INVENTION

1. Field of the Invention

The present invention relates to junction box devices and more particularly pertains to a new junction box device for mounting an electric outlet within a wall in such a manner that the outlet may be selectively moved in a lateral direction.

2. Description of the Prior Art

The use of junction box devices is known in the prior art. While these devices fulfill their respective, particular objectives and requirements, the need remains for a device that is configured for allowing an electrical outlet to be lateral moved to ensure that it is properly placed when a covering is positioned over the outlet.

SUMMARY OF THE INVENTION

The present invention meets the needs presented above by generally comprising a housing that has a bottom wall, a top wall, a first side wall, a second side wall and a rear wall. A front side of the housing is open and has an upper edge, a lower edge, a first side edge and a second side edge. The housing has a plurality of removable sections therein. Each of the first and second side walls has at least one of the removable sections therein. The bottom wall has a plurality of first aligned slots therein positioned adjacent to the lower edge. The top wall has a plurality of second aligned slots therein positioned adjacent to the upper edge. Each of a pair of mounting members is elongated and has a front end and a back end. Each of the mounting members has an aperture therein extending through respective ones of the front and back ends. Fasteners may be extended through mounting tabs on the electrical outlet and into one of the mounting members. Each coupler, of a pair of couplers, is attached to one of the mounting members. The couplers are positioned between an associated one of the first and second ends and each is removably extendable into one of the slots of the first and second aligned slots so that the apertures are orientated substantially perpendicular to a plane of the front side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
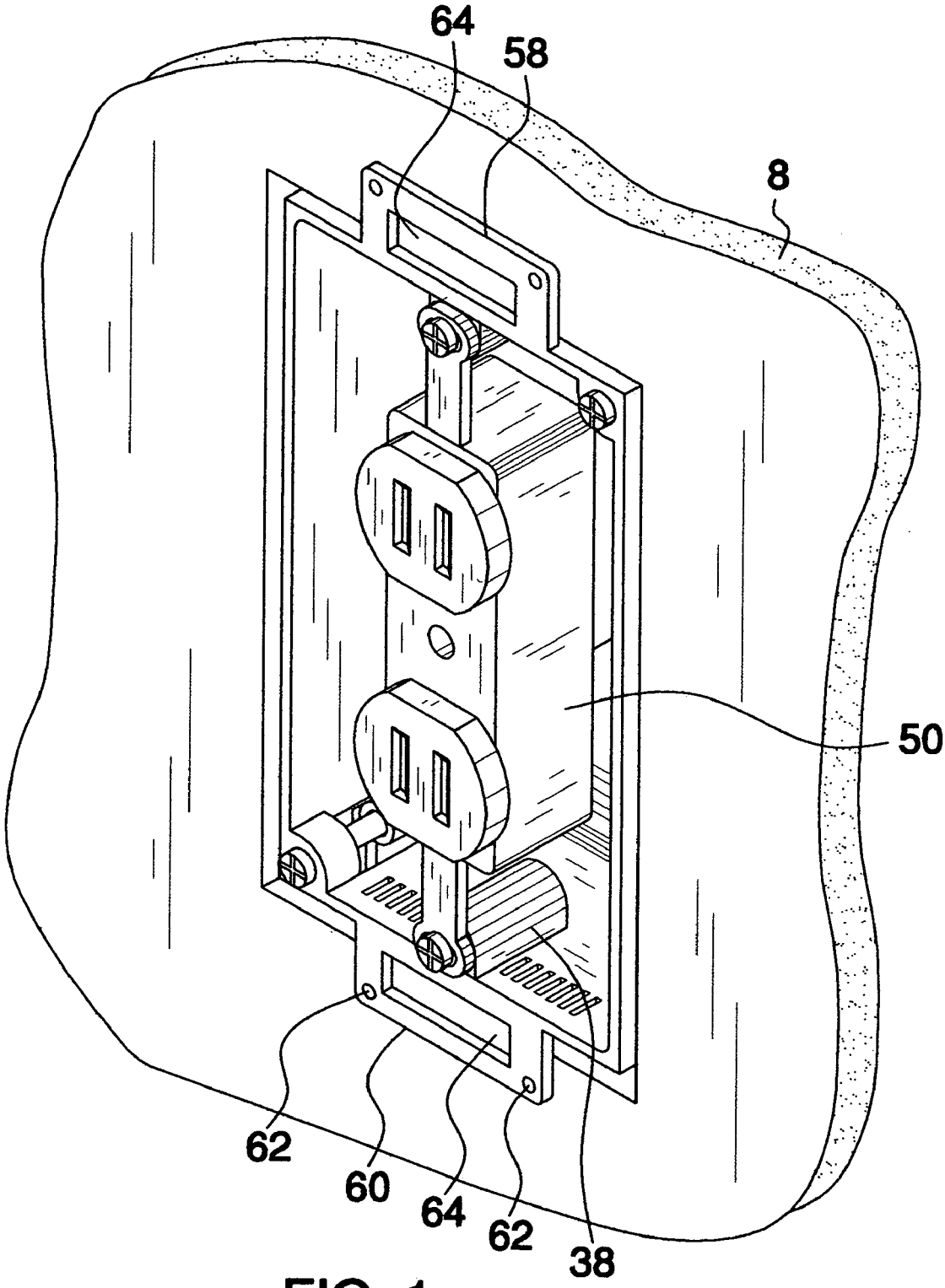
FIG. 1 is a perspective view of a junction box apparatus according to the present invention.

With reference now to the drawings, and in particular to FIGS. 1 through 6 thereof, a new junction box device embodying the principles and concepts of the present invention and generally designated by the reference numeral 10 will be described.

As best illustrated in FIGS. 1 through 6, the junction box apparatus 10 generally comprises a housing 12 that has a bottom wall 14, a top wall 16, a first side wall 18, a second side wall 20 and a rear wall 22. A front side of the housing 12 is open and has an upper edge 24, a lower edge 26, a first side edge 28 and a second side edge 30. The housing 12 has a plurality of removable sections 32 extending therein formed by perforations to allow a user to punch the removable sections 32 out. Each of the first 18 and second 20 side walls has at least one of the removable sections 32 therein. The bottom wall 14 has a plurality of first aligned slots 34 therein positioned adjacent to the lower edge 26 and the top wall 16 has a plurality of second aligned slots 36 therein positioned adjacent to the upper edge 24.

A pair of mounting members 38 is provided. Each of the mounting members 38 is elongated and has a front end 40 and a back end 42. Each of the mounting members 38 has an aperture 44 therein. The apertures 44 extend through respective ones of the front 40 and back 42 ends. Fasteners 46 may be extended through mounting tabs 48 on an electrical outlet 50 and into one of the mounting members 38.

Figure 4:
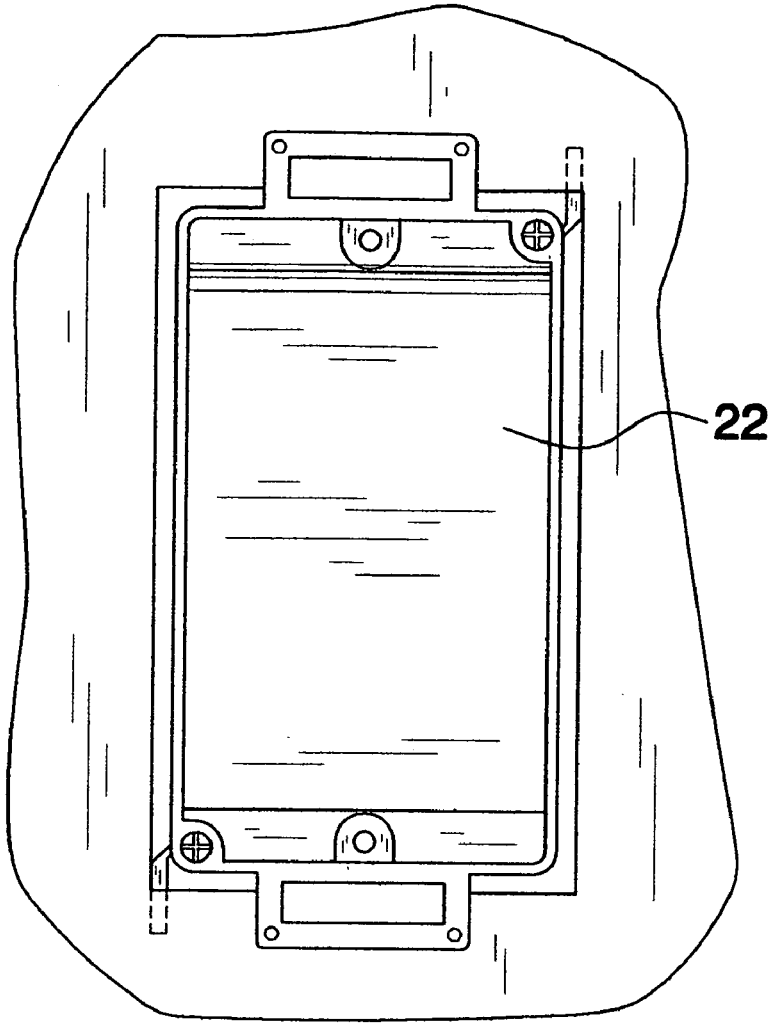
FIG. 4 is a front view of the present invention.
Figure 5:
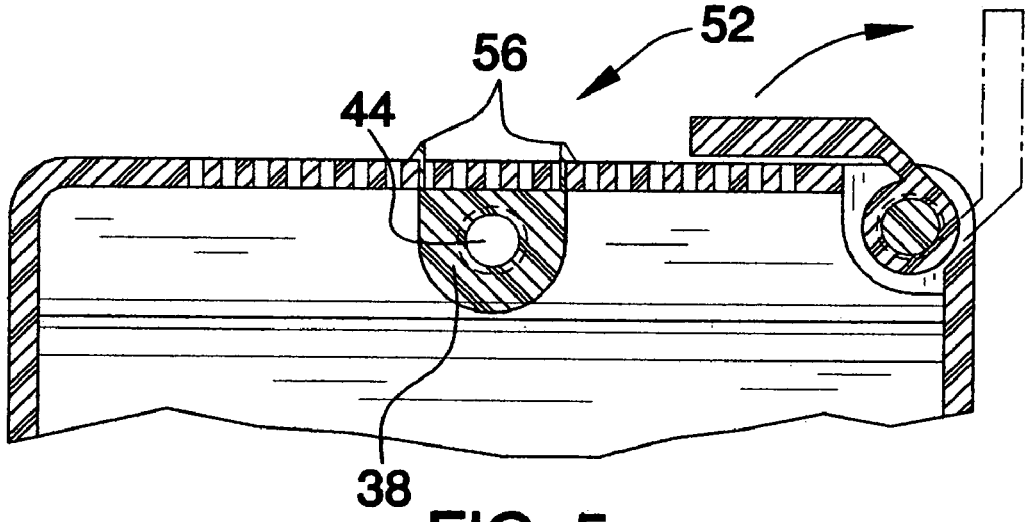
FIG. 5 is a cross-sectional view taken along line 5—5 of FIG. 1 of the present invention.
Figure 6:
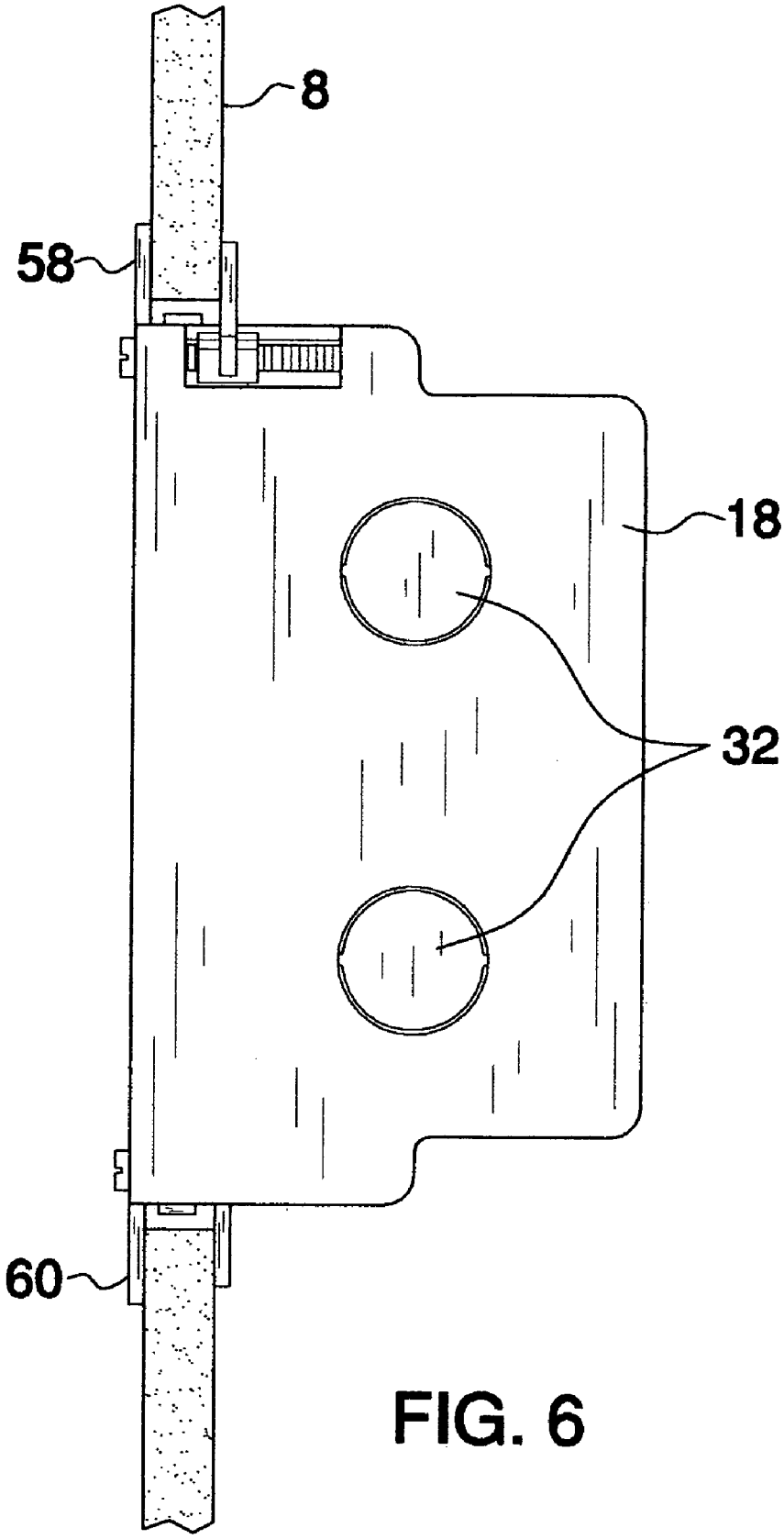
FIG. 6 is a side view of the present invention.

A pair of couplers 52 is also provided. Each of the couplers 52 is attached to one of the mounting members 38. Each of the couplers 52 is positioned between an associated one of the first 40 and second 42 ends. The couplers 52 are each removably extendable into one of the slots of the first 34 and second 36 aligned slots so that the apertures 44 are orientated substantially perpendicular to a plane of the front side of the housing 12. Each of the couplers 52 comprises a pair of arms 54 positioned adjacent to each other and extending in a same direction away from a respective one of the mounting members 38. The arms 54 each have a free end 56 forming a catch. As shown in FIG. 4, each of the arms 54 are extendable into one of the slots of the first 34 and second 36 aligned slots to secure an attached one of the mounting members 38 to a respective one of the top 16 and bottom 14 walls.

An upper tab 58 is attached to the top wall 16 and extends upwardly therefrom. A lower tab 60 is attached to the bottom wall 14 and extends downwardly therefrom. The upper tab 58 is positioned adjacent to and extends along the upper edge 24 while the lower tab 60 is positioned adjacent to and extends along the lower edge 26. Each of the upper 58 and lower 60 tabs has a plurality of openings 62 extending therethrough positioned adjacent to peripheral edges of the upper 58 and lower 60 tabs. Fasteners may be extended through these openings 62 to attach the housing to wall 8. The upper 58 and lower 60 tabs each has an elongated slot 64 therein positioned adjacent to a respective one of the top 16 and bottom 14 walls. The slots 64 allow a person to insert a tool between the wall 8 in which the housing 12 is mounted and the top 16 or bottom 14 walls to push the arms 54 out of the first 34 and second 36 aligned slots in order to move the mounting members 38.

An upper locking member 66 is rotatably mounted in a juncture of the top wall 16 and the first side wall 18. The upper locking member 66 includes a lever that is selectively positionable in a retracted position abutting the top wall 16 and an extended position extending away from the top wall 16. The upper locking member 66 has an outer end 68 extending forward of the front side of the housing 12 and is configured to engage a tool, such as a screwdriver, for rotating the upper locking member 66. A lower locking member 70 is rotatably mounted in a juncture of the bottom wall 14 and the second side wall 20. The lower locking member 70 includes a lever that is selectively positionable in a retracted position abutting the bottom wall 14 and an extended position extending away from the bottom wall 16. The lower locking member 70 has an outer end 72 extending forward of the front side of the housing 12 and is configured to engage a tool for rotating the lower locking member 70.

Figure 2:
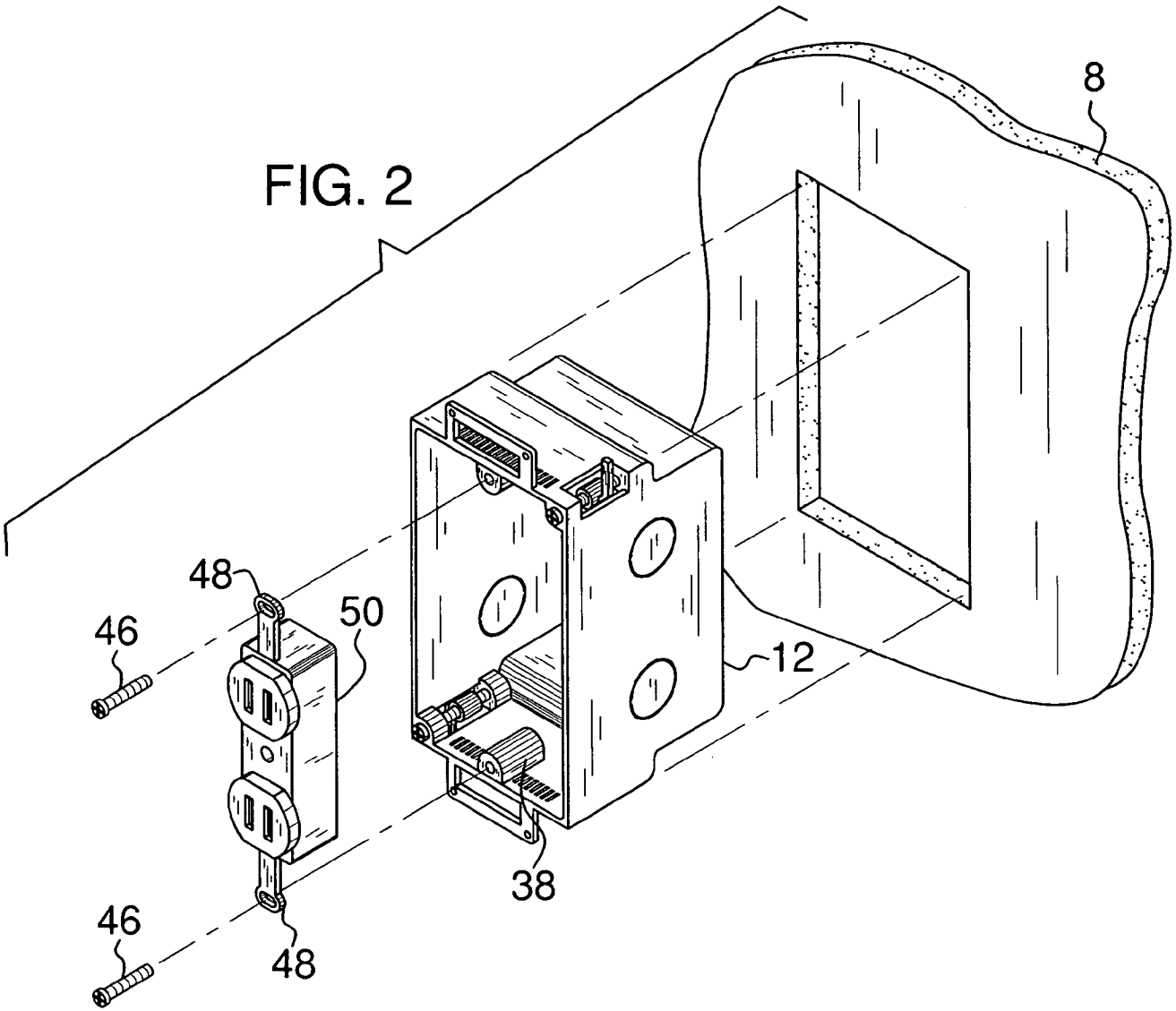
FIG. 2 is an exploded perspective view of the present invention.
Figure 3:
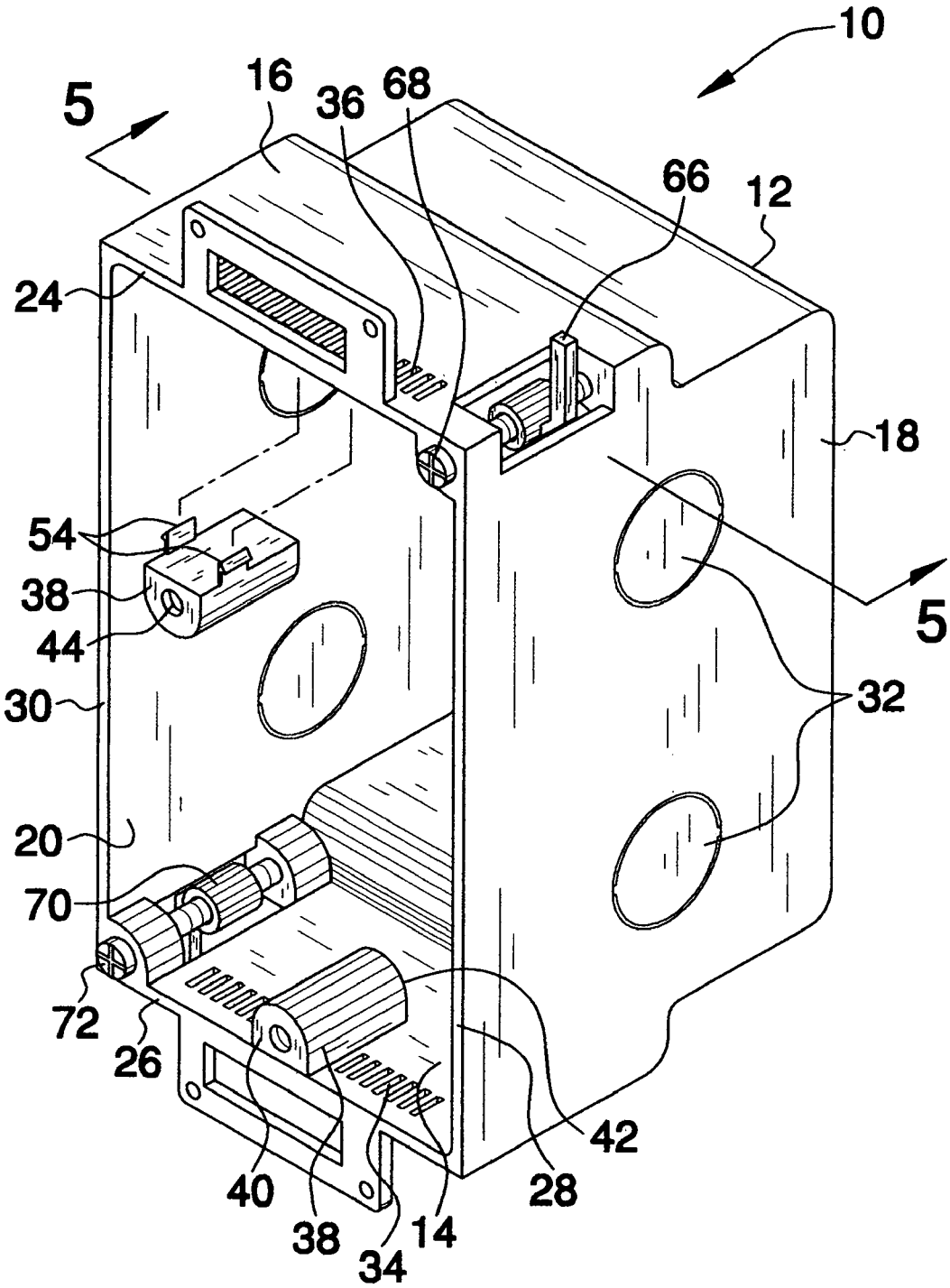
FIG. 3 is a perspective view of a housing of the present invention.

In use, the housing 12 is extended through an opening in a wall 8, such as sheetrock, as shown in FIG. 2. Once in place, the upper 66 and lower 70 locking members are rotated to hold the wall 8 between themselves and the upper 58 and lower 60 tabs. The user of the apparatus 10 may attach the couplers 38 to the first 34 and second 36 aligned slots where needed to ensure proper alignment of the outlet 50 with respect to the positioning of a faceplate, not shown, that will be positioned over and attached to the outlet 50. It should be understood that the outlet 50 may instead comprise a light switch.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical junction box assembly configured for receiving an electrical outlet, said assembly comprising:

a housing having a bottom wall, a top wall, a first side wall, a second side wall and a rear wall, a front side of said housing being open and having an upper edge, a lower edge, a first side edge and a second side edge, said housing having a plurality of removable sections therein, each of said first and second side walls having at least one of said removable sections therein, said bottom wall having a plurality of first aligned slots therein positioned adjacent to said lower edge, said top wall having a plurality of second aligned slots therein positioned adjacent to said upper edge;

a pair of mounting members, each of said mounting members being elongated and having a front end and a back end, each of said mounting members having an aperture therein, said apertures extending through respective ones of said front and back ends, wherein fasteners may be extending through mounting tabs on the electrical outlet and into one of said mounting members;

a pair of couplers, each of said couplers being attached to one of said mounting members, each of said couplers being positioned between an associated one of said first and second ends, each of said couplers being removably extendable into one of said slots of said first and second aligned slots wherein said apertures are orientated substantially perpendicular to a plane of said front side.

2. The assembly according to claim 1, wherein each of said couplers comprises a pair of arms positioned adjacent to each other and extending in a same direction away from a respective one of said mounting members, each of said arms having a free end forming a catch, wherein each of said arms are extendable into one of said slots of said first and second aligned slots to secure an attached one of said mounting members to a respective one of said top and bottom walls.

3. The assembly according to claim 1, further including an upper tab being attached to said top wall and extending upwardly therefrom, a lower tab being attached to said bottom wall and extending downwardly therefrom, said upper tab being positioned adjacent to and extending along said upper edge, said lower tab being positioned adjacent to and extending along said lower edge, each of said upper and lower tabs having a plurality of openings extending therethrough positioned adjacent to peripheral edges of said upper and lower tabs.

4. The assembly according to claim 3, wherein each of said upper and lower tabs has an elongated slot therein positioned adjacent to a respective one of said top and bottom walls.

5. The assembly according to claim 1, further including an upper locking member being rotatably mounted in a juncture of said top wall and said first side wall, said upper locking member including a lever being selectively positionable in a retracted position abutting said top wall and an extended position extending away from said top wall, said upper locking member having an outer end extending forward of said front side and being configured to engage a tool for rotating said upper locking member.

6. The assembly according to claim 5, further a lower locking member being rotatably mounted in a juncture of said bottom wall and said second side wall, said lower locking member including a lever being selectively positionable in a retracted position abutting said bottom wall and an extended position extending away from said bottom wall, said lower locking member having an outer end extending forward of said front side and being configured to engage a tool for rotating said lower locking member.

7. An electrical junction box assembly configured for receiving an electrical outlet, said assembly comprising:

a housing having a bottom wall, a top wall, a first side wall, a second side wall and a rear wall, a front side of said housing being open and having an upper edge, a lower edge, a first side edge and a second side edge, said housing having a plurality of removable sections extending therein, each of said first and second side walls having at least one of said removable sections therein, said bottom wall having a plurality of first aligned slots therein positioned adjacent to said lower edge, said top wall having a plurality of second aligned slots therein positioned adjacent to said upper edge;

a pair of mounting members, each of said mounting members being elongated and having a front end and a back end, each of said mounting members having an aperture therein, said apertures extending through respective ones of said front and back ends, wherein fasteners may be extending through mounting tabs on the electrical outlet and into one of said mounting members;

a pair of couplers, each of said couplers being attached to one of said mounting members, each of said couplers being positioned between an associated one of said first and second ends, each of said couplers being removably extendable into one of said slots of said first and second aligned slots wherein said apertures are orientated substantially perpendicular to a plane of said front side, each of said couplers comprising a pair of arms positioned adjacent to each other and extending in a same direction away from a respective one of said mounting members, each of said arms having a free end forming a catch, wherein each of said arms are extendable into one of said slots of said first and second aligned slots to secure an attached one of said mounting members to a respective one of said top and bottom walls;

an upper tab being attached to said top wall and extending upwardly therefrom, a lower tab being attached to said bottom wall and extending downwardly therefrom, said upper tab being positioned adjacent to and extending along said upper edge, said lower tab being positioned adjacent to and extending along said lower edge, each of said upper and lower tabs having a plurality of openings extending therethrough positioned adjacent to peripheral edges of said upper and lower tabs, each of said upper and lower tabs having an elongated slot therein positioned adjacent to a respective one of said top and bottom walls;

an upper locking member being rotatably mounted in a juncture of said top wall and said first side wall, said upper locking member including a lever being selectively positionable in a retracted position abutting said top wall and an extended position extending away from said top wall, said upper locking member having an outer end extending forward of said front side and being configured to engage a tool for rotating said upper locking member; and a lower locking member being rotatably mounted in a juncture of said bottom wall and said second side wall, said lower locking member including a lever being selectively positionable in a retracted position abutting said bottom wall and an extended position extending away from said bottom wall, said lower locking member having an outer end extending forward of said front side and being configured to engage a tool for rotating said lower locking member.

* * * * *